US005478257A

United States Patent [19]

Cachina et al.

[11] Patent Number: 5,478,257

[45] Date of Patent: Dec. 26, 1995

[54] RETENTION DEVICE

[75] Inventors: Joseph S. Cachina, Bridgeport; Anthony J. Malgioglio, Stamford, both of Conn.

[73] Assignee: Burndy Corporation, Norwalk, Conn.

[21] Appl. No.: 224,330

[22] Filed: Apr. 7, 1994

[51] Int. Cl.[6] ..... H01R 13/60

[52] U.S. Cl. ..... 439/567; 439/571

[58] Field of Search ..... 439/567, 571, 439/82, 55, 733, 751

[56] References Cited

U.S. PATENT DOCUMENTS

| | | | |
|---|---|---|---|
| 2,329,471 | 9/1943 | King | 85/2 |
| 2,933,007 | 4/1960 | Healy | 85/2.4 |
| 3,613,043 | 10/1971 | Scheller et al. | 339/17 C |
| 3,812,447 | 5/1974 | Eifler et al. | 339/59 R |
| 4,359,258 | 11/1982 | Palecek et al. | 339/176 MP |
| 4,413,875 | 11/1983 | Mattingly | 339/217 R |
| 4,511,200 | 4/1985 | Belokin, Jr. | 339/50 R |
| 4,616,893 | 10/1986 | Feldman | 339/14 R |
| 4,620,757 | 11/1986 | Thevenaz | 339/17 C |
| 4,907,979 | 3/1990 | Feldman | 439/83 |
| 4,907,987 | 3/1990 | Douty et al. | 439/571 |
| 4,941,847 | 7/1990 | Welsh | 439/595 |
| 5,035,656 | 7/1991 | Patel | 439/733 |
| 5,064,391 | 11/1991 | Buchter | 439/733 |
| 5,073,119 | 12/1991 | Soes | 439/82 |
| 5,074,807 | 12/1991 | Parmer | 439/567 X |
| 5,080,611 | 1/1992 | Hypes | 439/567 |
| 5,083,942 | 1/1992 | Hahn | 439/567 |
| 5,122,075 | 6/1992 | Kile | 439/329 |
| 5,135,412 | 8/1992 | Sitzler | 439/571 |
| 5,147,227 | 9/1992 | Yurko | 439/733 |
| 5,147,228 | 9/1992 | Miller et al. | 439/742 |
| 5,228,870 | 7/1993 | Gorenc et al. | 439/567 |

*Primary Examiner*—Khiem Nguyen
*Attorney, Agent, or Firm*—Perman & Green

[57] ABSTRACT

A device for connecting a first member to a second member. The device has a first end that is inserted into a hole of the first member and fixedly mounted therein. A second opposite end of the device has two parallel spaced arms. The arms are mirror images of each other. Each arm has an opposing interior cam surface and two pair of exterior cam surfaces along their lengths. The arms are inserted into a hole in the second member to retain the device in the second member's hole.

19 Claims, 2 Drawing Sheets

FIG. 2A
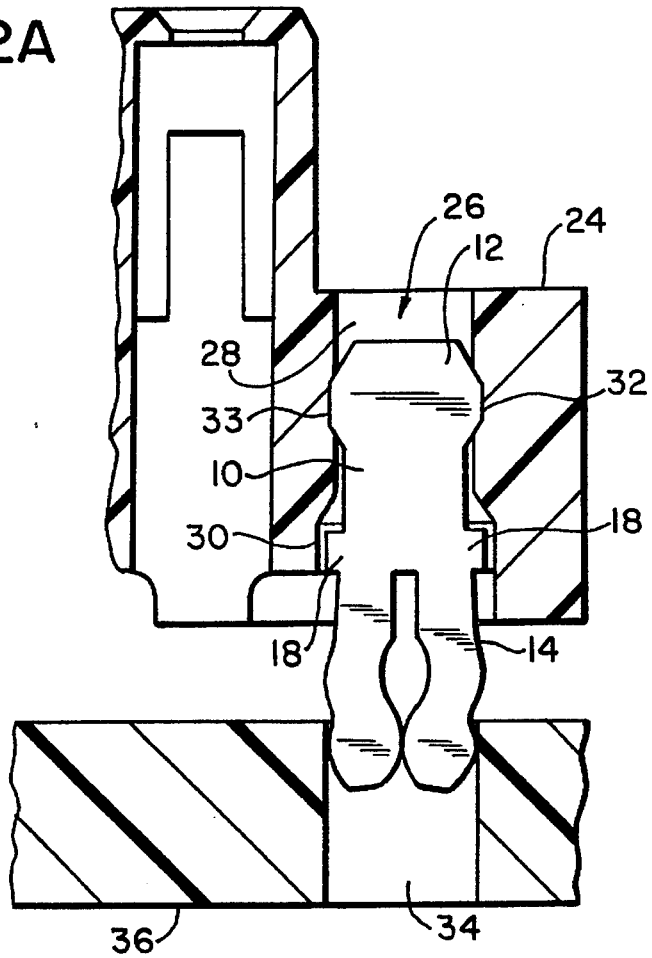
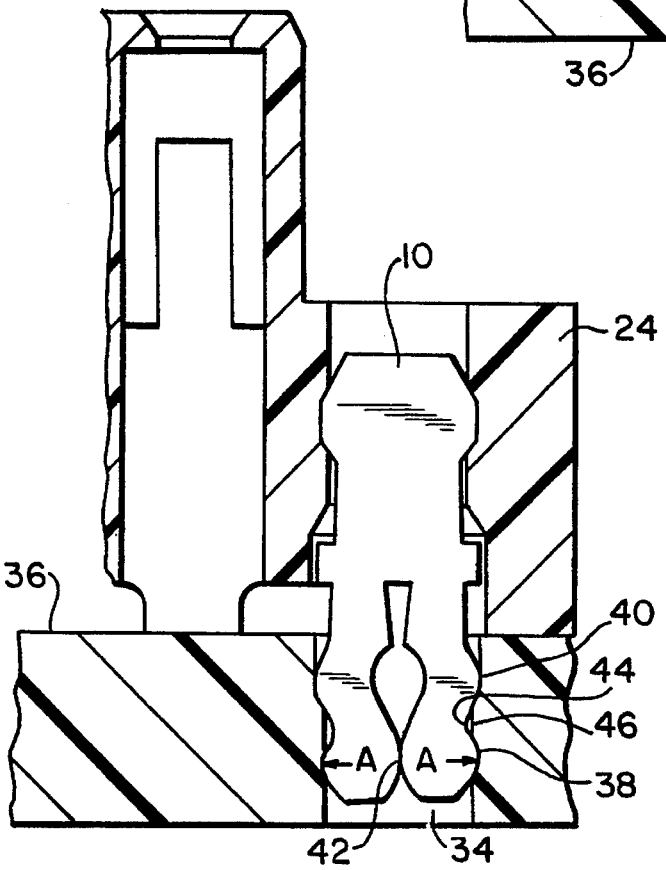
FIG. 2B

RETENTION DEVICE

BACKGROUND OF THE INVENTION

1. Field of the Invention

The present invention relates to retaining two members together and, more particularly, to a device for connecting two members to each other having deflectable arms inserted into a hole of one of the members.

2. Prior Art

U.S. Pat. No. 5,228,870 discloses a holding device having a flat shape, a crossarm section, a first projection press-fit into a hole of one member, and a second projection press-fit into a hole of a second member. The second projection has legs with a pair of barbs on each leg. U.S. Pat. No. 5,135,412 shows a similar design. U.S. Pat. No. 2,329,471 discloses an electrical terminal with feet that cam leg members outward as the terminal is inserted into a hole. The following U.S. Patents show other retention systems:

| | |
|---|---|
| 2,933,007 | 3,613,043 |
| 3,812,447 | 4,359,258 |
| 4,413,875 | 4,511,200 |
| 4,616,893 | 4,620,757 |
| 4,907,979 | 4,907,987 |
| 4,941,847 | 5,035,656 |
| 5,064,391 | 5,073,119 |
| 5,080,611 | 5,083,942 |
| 5,122,075 | 5,147,227 |
| 5,147,228 | |

SUMMARY OF THE INVENTION

In accordance with one embodiment of the present invention, in a retention device for connecting a first member to a second member, the retention device having an end with two spaced cantilever arms adapted to be inserted into a hole of the second member and fixed therein, the improvement comprises the arms each having a first exterior cam surface, a second exterior cam surface, and an interior cam surface. The arms are suitably sized and shaped relative to the hole such that insertion of the arms into the hole causes the interior cam surfaces to contact each other because of deflection of the arms due to contact of the first exterior cam surfaces with the second member and, as the arms are further inserted into the hole, the second exterior cam surfaces are deflected towards each other, due to contact with the second member, and the first exterior cam surfaces are moved outward due to contact and camming movement of the arms at the interior cam surfaces.

In accordance with another embodiment of the present invention a retention system for connecting a first member to a second member is provided comprising a first section and a second section. The first section is for connection to the first member. The second section is for connection to the second member. The second section has two mounting arms for positioning in a hole of the second member, the arms comprising opposing cam surfaces and two pair of outwardly facing deflection and gripping areas. The second section is suitably sized and shaped such that when a second pair of the areas is inserted into the hole, with the first pair of areas inside the hole and the opposing cam surfaces contacting each other, the second pair of areas is compressed by the second member with the arms moving at the opposing cam surfaces to outwardly expand the first pair of areas and thereby lock the second section in the hole of the second member.

In accordance with another embodiment of the present invention a retention device is provided comprising a first section and a second section. The first section is for connecting the retention device to a first member. The second section is for connecting the retention device to a second member. The second section includes two generally parallel spaced cantilever arms. Each arm has an opposing interior cam surface and two pair of exterior cam surfaces along their lengths. The exterior cam surfaces have arcuate shapes with a solder reflow area therebetween.

BRIEF DESCRIPTION OF THE DRAWINGS

The foregoing aspects and other features of the invention are explained in the following description, taken in connection with accompanying drawings, wherein:

FIG. 2A is a schematic cross sectional partial view of the retention device shown in FIG. 1 being used to connect a first member to a second member shown at an intermediate connection position;

FIG. 2B is a schematic partial cross sectional view as shown in FIG. 2A with the two members in a final connection position;

DETAILED DESCRIPTION OF THE INVENTION

Figure 1:
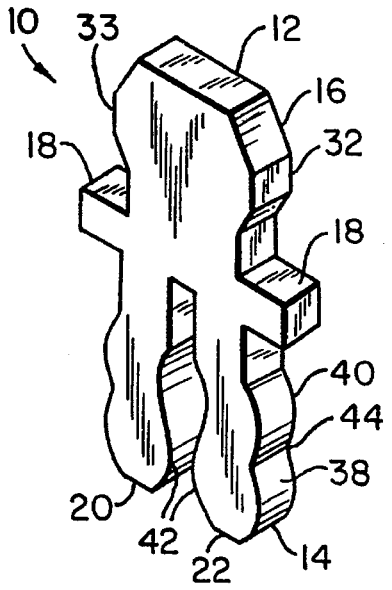
FIG. 1 is a perspective view of a retention device incorporating features of the present invention.

Referring to FIG. 1, there is shown a perspective view of a retention device 10 incorporating features of the present invention. Although the present invention will be described with reference to the embodiments shown in the drawings, it should be understood that features of the present invention could be included in various different types and forms of alternate embodiments. In addition, any suitable size, shape, or type of elements or materials could be used.

The device 10, in the embodiment shown, is a one-piece member preferably made of a suitable flat stock material, such as sheet metal. The device has a first end 12 and an opposite second end 14. The first end 12 forms a first mounting section for mounting the first end 12 to a first member. The second end 14 forms a second mounting section for mounting the second end 14 to a second member. The first section generally comprises a single enlarged head 16 and two laterally extending stabilizer arms 18. The second mounting section generally comprises two spaced cantilever arms 20, 22. In a preferred embodiment, the device 10 is solder plated to provide lubricity, cold weldment, and permanent retention after soldering.

Referring also to FIGS. 2A and 2B, the device 10 is shown with its first end 12 fixedly and stationarily mounted to a first member 24 in a hole 26. In the embodiment shown, the first member 24 is the housing of an electrical connector. However, in an alternate embodiment, the first member 24 could be any suitable type of member. The housing 24 is made of dielectric material, such as a molded plastic or polymer material. The hole 26 has a first section 28 and a second section 30. The first section 28 has a width slightly less than the width of enlarged head 16. The device 10 is inserted into the housing 24 through the bottom of the hole 26. Because the width of the head 16 is wider than the width of the first section 28, the sides 32, 33 of the head 16 penetrate the housing 24 and make an interference fit therewith. This interference fit stationarily and fixedly holds the first end 12 in the hole 26. The stabilizer arms 18 are located in the second section 30. The stabilizer arms function to stabilize the first end 12 in the hole 26 to prevent axial twisting of the device 10 in the hole 26.

The second end 14 of the device 10 is adapted to be inserted into the hole 34 of the second member 36. In the embodiment shown, the second member 36 is a printed circuit board that the electrical connector will be electrically and mechanically connected to. However, the second member 36 could be comprised of any suitable type of member or device. The width of the second end 14 is wider than the width of the hole 34 before insertion of the second end 14 into the hole 34.

Figure 3:
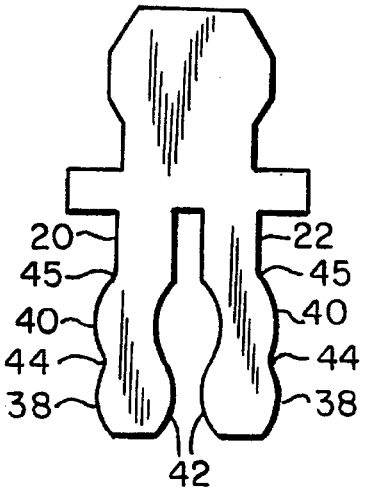
FIG. 3 is a front elevational view of the retention device shown in FIG. 1.

Referring also to FIG. 3, the two cantilever arms 20, 22 are mirror images of each other. However, in alternate embodiments, the arms 20, 22 could have different shapes and, more than two arms could be provided. Each arm generally comprises a first exterior cam surface 38, a second exterior cam surface 40, an interior cam surface 42, and a recessed solder reflow area 44. The surfaces 38, 40, 42, in the embodiment shown, all have arcuate shapes. In alternate embodiments, other types of shapes might be used. Before insertion into the hole 34, the two interior cam surfaces 42 are spaced from each other. The arms 20, 22, are deflectable towards each other.

As shown in FIG. 2A, when the second end 14 is initially inserted into the hole 34, the sloped shape of the first exterior cam surface 38 causes the arms 20, 22 to be deflected towards each other in a cantilever fashion. The arms are deflected such that the two formerly spaced interior cam surfaces 42 now contact each other. This contact of the interior cam surfaces 42 with each other stops the inward deflection of the two first exterior cam surfaces 38. Upon further insertion of the second end 14 into the hole 34, as shown in FIG. 2B, the second exterior cam surfaces 40 enter the hole 34. The second surfaces 40 are deflected towards each other, at least slightly, by the interior walls of the hole 34. However, because the interior cam surfaces 42 have already been pushed into contact with each other when the first surfaces 38 entered the hole 34, the arms 20, 22 are cammed or pivot against each other at the interior surfaces 42 as the second exterior surfaces 40 are deflected inward. The camming action at the interior cam surfaces 42 cause the first exterior cam surfaces 38 to be cammed or pushed outward as shown by arrows A. This causes the first exterior cam surfaces 38 to project deeper into the walls of the hole 34 than previously done during the insertion path of the first surfaces 38 along the hole 34 before the second surfaces entered the hole. The insertion of the first surfaces 38 into the hole 34, thus, has two types of insertions. The first type of insertion occures before the second surfaces 42 enter the hole 34 and, comprises no significant projection of the first surfaces 38 into the walls of the hole 34. The second type of insertion occures when the second surfaces 42 enter the hole 34 and, the first surfaces 38 are cammed outward to project into the side walls of the hole 34. The second surfaces 42 also project into the side walls of the hole 34 and make an interference fit therewith. The combination of the second exterior surfaces 42 interference fit with the second member 36 and the cammed projection interference fit of the first exterior surfaces 38 with the second member 36 provides an enhanced connection. More specifically, it provides a combined press-fit insertion and a cam-lock interference.

As noted above, the embodiment shown is for connecting an electrical connector 24 to a printed circuit board 36. Reflow soldering is often used to electrically connect contacts (not shown) of the connector 24 to conductors (not shown) on the board 36. The device 10 uses its unique shape to reduce the amount of solder plowed out of the hole 34 by the arms 20, 22 and, allows reflow of displaced solder behind the points of applied load on each arm. In other words, solder can flow into reflow areas 44 of the arms. Areas 45 also function as solder reflow areas. Thus, more reflow of solder can occur. The arms 20, 22 are also constructed such that deflection of the arms is beyond the yield point. This creates an interfering compliant cross section by impacting the free end of each arm; making it dual supported. Each of the four high pressure contact points at surfaces 38 and 40 with the board 36 also can generate a solder to solder cold frame weldment. Features of the present invention could also be used to connect electrical contacts to a housing, connect two housing pieces to each other, etc.

Figure 4:
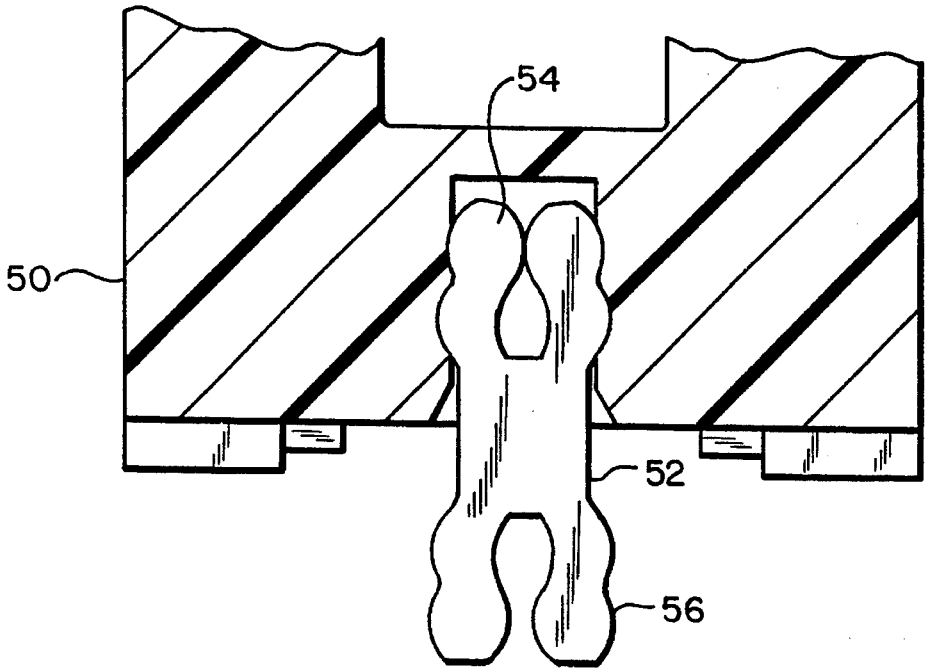
FIG. 4 is a schematic partial cross sectional view of a member with an alternate embodiment of the retention device of the present invention connected thereto.

Referring now to FIG. 4, there is shown a partial cross-sectional view of a connector housing 50 with an alternate embodiment of a device 52 connected thereto. In the device 52 shown, the first end 54 is a mirror image of the second end 56. This embodiment is shown to illustrate that features of the present invention can be used with any suitable type of second and/or first end and, can be used to attach to a housing rather than only to a printed circuit board. The first end 54 is not solder plated, but can nonetheless form an excellent interference fit with the connector housing 50.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a retention device for connecting a first member to a second member, the retention device having an end with two spaced cantilever arms adapted to be inserted into a hole of the second member and fixed therein, the improvement comprising:

the arms each having a first exterior cam surface, a second exterior cam surface, and an interior cam surface, the arms being suitably sized and shaped relative to the hole such that insertion of the arms into the hole causes the interior cam surfaces to contact each other because of deflection of the arms due to contact of the first exterior cam surfaces with the second member and, as the arms are further inserted into the hole, the second exterior cam surfaces are deflected towards each other due to contact with the second member and the first exterior cam surfaces are moved outward due to contact and camming movement of the arms with each other at the interior cam surfaces, wherein the first and second exterior cam surfaces have arcuate shapes.

2. A device as in claim 1 wherein the arms each have a solder reflow area between the first and second exterior cam surfaces.

3. A device as in claim 1 further comprising stabilizer arms.

4. A device as in claim 1 further comprising an opposite end adapted for press-fit mounting in a hole of the first member.

5. A device as in claim 4 wherein the end and the opposite end are substantial mirror images of each other.

6. A device as in claim 1 wherein the device is substantially flat.

7. A device as in claim 1 further comprising solder plating.

8. A retention system for connecting a first member to a second member, the system comprising:

a first section for connection to the first member; and a second section for connection to the second member, the second section having two mounting arms for positioning in a hole of the second member, the arms comprising opposing cam surfaces and two pair of outwardly facing deflection and gripping areas, wherein the first section is substantially identical to the second section and the second section is suitably sized and shaped such that when a second pair of the two pair of areas is inserted into the hole, with the first pair of the areas inside the hole and the opposing cam surfaces contacting each other, the second pair of areas is compressed by the second member with the arms moving at the opposing cam surfaces to outwardly expand the first pair of areas and thereby lock the second section in the hole of the second member.

9. A system as in claim 8 wherein the first and second sections are comprised of a single retention member made from sheet metal.

10. A system as in claim 8 wherein the deflection and gripping areas have arcuate shapes.

11. A system as in claim 8 wherein the arms are spaced from each other prior to insertion into the hole.

12. A system as in claim 8 wherein the first section has stabilizer arms.

13. A retention device comprising:

a first section for connecting the retention device to a first member; and a second section for connecting the retention device to a second member, the second section including two generally parallel spaced cantilever arms, the arms each having opposing interior cam surfaces and two pair of exterior cam surfaces along their lengths, the exterior cam surfaces having arcuate shapes with a solder reflow area therebetween.

14. A device as in claim 13 wherein the first section is a substantial mirror image of the second section.

15. A device as in claim 14 wherein the device has a general "H" shape.

16. A device as in claim 13 wherein the device has a generally flat shape.

17. A device as in claim 13 wherein the first section has a single enlarged head for press-fit insertion into a hole of the first member.

18. A device as in claim 17 wherein the first section further comprises stabilizer arms.

19. A retention system for connecting a first member to a second member, the system comprising:

a first section for connection to the first member; and a second section for connection to the second member, the second section having two mounting arms for positioning in a hole of the second member, the arms comprising opposing cam surfaces and two pair of outwardly facing deflection and gripping areas, wherein the first and second sections are comprised of a single retention member made from sheet metal and the second section is suitably sized and shaped such that when a second pair of the two pair of areas is inserted into the hole, with the first pair of the areas inside the hole and the opposing cam surfaces contacting each other, the second pair of areas is compressed by the second member with the arms moving at the opposing cam surfaces to outwardly expand the first pair of areas and thereby lock the second section in the hole of the second member.

* * * * *